US006255578B1

(12) United States Patent
Eitaki et al.

(10) Patent No.: US 6,255,578 B1
(45) Date of Patent: Jul. 3, 2001

(54) TONE COLOR SETTING DEVICE OF ELECTRONIC MUSICAL INSTRUMENT

(75) Inventors: Shu Eitaki; Tadayuki Ishida, both of Hamamatsu (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 0 days.

(21) Appl. No.: 09/555,321

(22) PCT Filed: Sep. 22, 1999

(86) PCT No.: PCT/JP99/05177

§ 371 Date: May 24, 2000

§ 102(e) Date: May 24, 2000

(30) Foreign Application Priority Data

Sep. 28, 1998 (JP) ..... 10-273011

(51) Int. Cl.[7] ..... G10H 5/02
(52) U.S. Cl. ..... 84/659; 84/656
(58) Field of Search ..... 84/615, 618, 622, 84/659, 653, 656

(56) References Cited

U.S. PATENT DOCUMENTS 4,662,261 * 5/1987 Akutsu ..... 84/615
4,703,680 * 11/1987 Wachi et al. .
5,380,949 * 1/1995 Matsuda ..... 84/618
5,864,082 * 1/1999 Hirano ..... 84/659

FOREIGN PATENT DOCUMENTS 027210161 8/1995 (JP) .

OTHER PUBLICATIONS

Ritter Music, MIDI Bible, MIDI 1.0 Standard Basical Book, First edition published Nov. 1, 1997.
DTM Handbooks MIDI Book, By Jeff Rona, first edition published on Jul. 28, 1994.

* cited by examiner

*Primary Examiner*—Jeffrey Donels
(74) *Attorney, Agent, or Firm*—Bachman & Lapointe, P.C.

(57) ABSTRACT

A musical instrument having a signal output function 1 for outputting a given signal in response to a user command, and a mode managing function 2 for managing process modes of an electronic keyboard and compulsorily finishing an arbitrary process mode of the electronic keyboard when the signal is outputted by the signal output function 1, and for changing to a tone color selection mode after the compulsory finish for setting a tone color of the electronic keyboard to a given tone color. Even during each of the process modes, the tone color of the electronic musical instrument can be compulsorily set to a given one.

8 Claims, 5 Drawing Sheets

TONE COLOR SETTING DEVICE OF ELECTRONIC MUSICAL INSTRUMENT

TECHNICAL FIELD

The present invention relates to a tone color setting device for compulsorily setting a tone color of an electronic musical instrument to a given one according to a command from a user.

BACKGROUND ART

For setting a tone color in an electronic musical instrument of the type with a small number of tone colors, there are provided tone color switches for all the tone colors on a panel so that the tone color setting can be performed with one switch operation.

In the type with a large number of tone colors, it is not possible to provide tone color switches for all the tone colors on a panel, so that the same tone color selection procedure should be carried out for selecting either the most frequently used tone color of piano or a tone color which is used with a relatively low frequency. For example, operations are necessary such that a switch for entering a tone color selection mode is depressed, a number corresponding to the tone color is inputted using a ten key, an increment dial or the like, and then a switch for inputting a determination command is depressed. In another example, operations are necessary such that a switch for entering a tone color selection mode is depressed, a rotary operation member is operated to scroll a tone color display on a screen, and then a switch for inputting a determination command is depressed when a required color tone is displayed.

FIG. 6 is a flowchart showing the foregoing procedure which is executed upon interrupt during an arbitrary process mode. During an arbitrary process mode (step S301), an interrupt is executed (step S302) so that it is checked whether a tone color selection mode has been entered by turning on a tone color selection mode switch (step S303). If it is judged that the tone color selection mode has not been entered (step S303; No), the processing returns to the foregoing step S301. On the other hand, if it is judged that the tone color selection mode has been entered (step S303; Yes), a number corresponding to a target tone color is inputted using a ten key or an increment dial (or a tone color display on a screen is scrolled by operating a rotary operation member to display a required tone color), so that a tone color selection is performed (step S304). Then, it is checked whether a switch for inputting a tone color determination command is depressed (step S305). If the determining switch is depressed (step S305; Yes), the tone color setting is executed (step S306). On the other hand, if the determining switch is not depressed (step S305; No), the processing returns to the foregoing step S305.

It is difficult to execute the foregoing tone color setting during processing of each of various modes. For example, if a sound output is hastily required while setting functions under a plurality of hierarchies of a various-function setting mode, a tone color should be selected after operating cancel switches or the like corresponding to those hierarchies to stop the function setting and restoring an initial state (a normal mode before the function setting). On the other hand, in a musical instrument, such as an electronic organ, which can have a large panel area to provide a relatively large number of tone color switches, a piano setting switch is available on the panel so that a piano tone color can be set quickly. However, in case of stopping an automatic accompaniment function and setting only the piano tone color during an automatic accompaniment process mode, operations are necessary such that a switch for the automatic accompaniment function is turned off and then the piano tone color is selected.

The present invention has been made in view of the foregoing problems of the prior art and provides a tone color setting device which can compulsorily set a tone color of an electronic musical instrument to a given one according to a command from a user even during each of various process modes.

DISCLOSURE OF THE INVENTION

Therefore, a structure of a tone color setting device of an electronic musical instrument according to the present invention is basically characterized by a signal output means for outputting a given signal in response to a user command, a mode compulsorily finishing means for compulsorily finishing an arbitrary process mode of the electronic musical instrument when the signal is outputted by the signal output means, and a tone color setting means for setting a tone color of the electronic musical instrument to a given tone color after the compulsory finish.

In the foregoing embodiment, when a signal is outputted from the signal output means in response to a user command, the mode compulsorily finishing means compulsorily finishes an arbitrary process mode being executed at that time, and then the tone color setting means sets a tone color to a given tone color. In this structure, an arbitrary process mode is compulsorily finished through an action from the exterior either in case the electronic musical instrument is not provided with means for managing various process modes or in case it is provided with such mode managing means. For this purpose, the mode compulsorily finishing means and the tone color setting means are separately provided and perform the compulsory finish of the process mode and the compulsory tone color setting, respectively.

In a preferred embodiment the electronic musical instrument is provided with means for managing various process modes, which is used for the compulsory finish of the process mode and further for the compulsory tone color setting. The mode managing means performs the compulsory finish of the process mode, and includes a signal output means for outputting a given signal in response to a user command, a mode managing means for managing process modes of the electronic musical instrument and compulsorily finishing an arbitrary process mode of the electronic musical instrument when the signal is outputted by the signal output means, and a tone color setting means for setting a tone color of the electronic musical instrument to a given tone color after the compulsory finish.

In the foregoing embodiment, as described above, there is provided the mode managing means for managing process modes of the electronic musical instrument, which has a function of compulsorily finishing an arbitrary process mode of the electronic musical instrument when a signal is outputted from the signal output means. After the compulsory finish, the tone color setting means sets a tone color of the electronic musical instrument to a given tone color.

In a further embodiment the instrument includes a signal output means for outputting a given signal in response to a user command, and a mode managing means for managing process modes of the electronic musical instrument and compulsorily finishing an arbitrary process mode of the electronic musical instrument when the signal is outputted by the signal output means, and for changing to a tone color selection mode after the compulsory finish for setting a tone color of the electronic musical instrument to a given tone color.

In the foregoing embodiment, as described above, there is provided the mode managing means for managing process modes of the electronic musical instrument, which has functions of compulsorily finishing an arbitrary process mode of the electronic musical instrument and changing to the tone color selection mode for setting a tone color of the electronic musical instrument to a given tone color when a signal is outputted from the signal output means. Thus, after the signal is outputted from the signal output means in response to a user command, the mode managing means performs the compulsory finish of an arbitrary process mode being executed at that time and the change to the tone color selection mode to set the given tone color.

BEST MODE FOR CARRYING OUT THE INVENTION

Hereinbelow, a carrying-out mode structure of a tone color setting device of an electronic musical instrument according to the present invention will be described based on the accompanying drawings.

Figure 1:
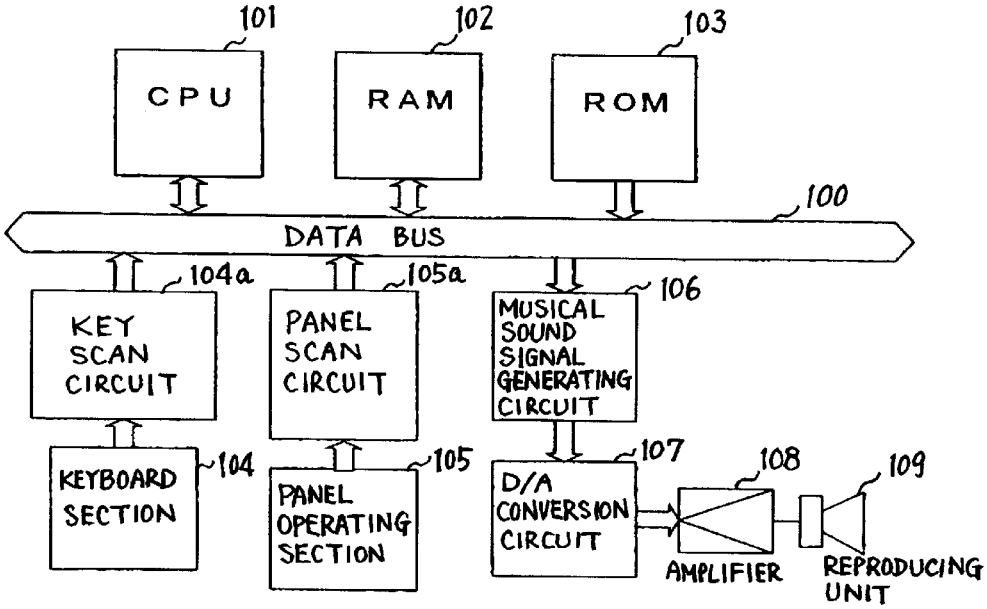
FIG. 1 is a schematic circuit diagram of an electronic keyboard provided with a tone color setting device of the present invention.
Figure 2:
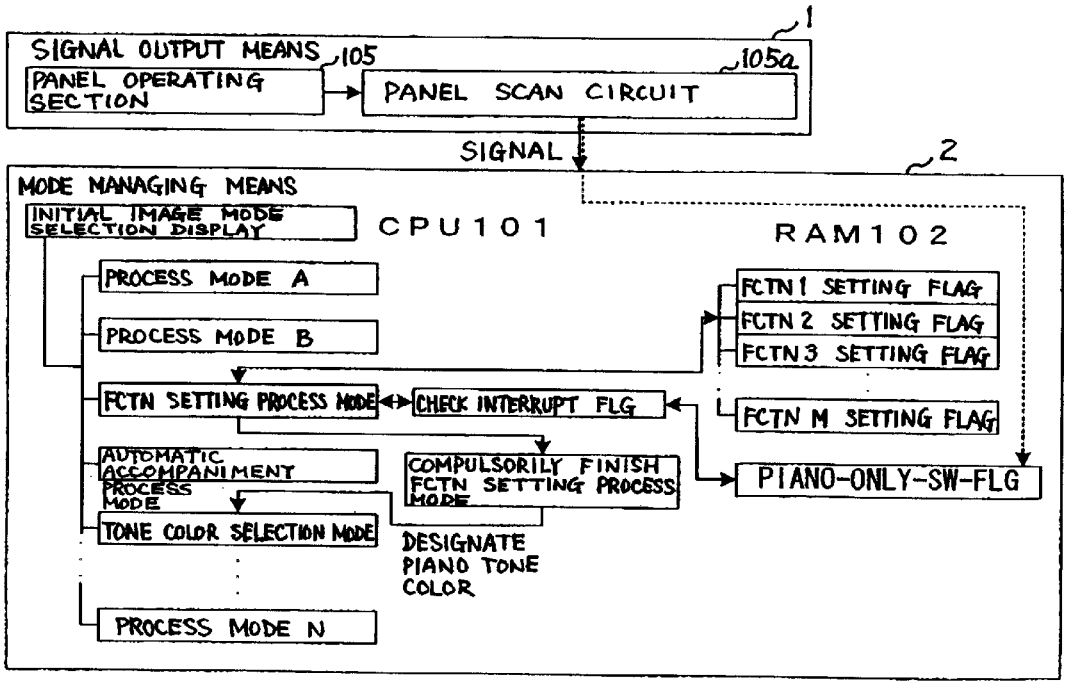
FIG. 2 is a functional block diagram of the tone color setting device according to the present invention.

FIG. 1 is a schematic circuit diagram of an electronic keyboard provided with a tone color setting device of the present invention. FIG. 2 shows a carrying-out mode structure of a tone color setting device of claim 3 provided in the electronic keyboard.

In FIG. 1, to a bus 100 are connected a CPU 101, a RAM 102, a ROM 103, a keyboard section 104 via a key scan circuit 104*a*, a panel operating section 105 via a panel scan circuit 105*a* where operations through panel switches are possible, and a musical sound signal generating circuit 106, respectively, and various commands and data are transferred to these devices via the bus 100. To the musical sound signal generating circuit 106 are electrically connected a D/A conversion circuit 107 for converting a generated musical sound into analog, an amplifier 108 for amplifying it, and a reproducing unit 109, such as a speaker, for outputting a sound to the outside.

FIG. 2 is a functional block diagram of the tone color setting device according to the present invention and comprises a signal output means 1 which outputs a given signal in response to a command from a user, and a mode managing means 2 which manages process modes of the electronic keyboard such that when a signal is outputted from the signal output means 1, it compulsorily finishes a process mode of the electronic keyboard and, after compulsorily finishing it, changes the mode into a tone color selection mode for setting a tone color of the electronic keyboard to a given tone color.

The signal output means 1 comprises the panel operating section 105 and the panel scan circuit 105*a*. The panel scan circuit 105*a* detects whether a piano-only-switch provided in the panel operating section 105 is depressed or not, and this detected signal (included in scanned data) is stored in the RAM 102 via the CPU 101. Specifically, in the CPU 101, the scanned data (NEW data) is compared with previous data (OLD data). If it is judged that the piano-only-switch is not operated in the OLD data while the piano-only-switch is operated in the NEW data, a piano-only-switch flag is set.

The mode managing means 2 comprises the CPU 101 and the RAM 102 and manages the process modes of the electronic keyboard. When the power turns on, a mode selection image is displayed as an initial image and, as shown in the figure, a process mode can be selected from among a process mode A, a process mode B, a function setting process mode, an automatic accompaniment process mode, a tone color selection mode, . . . and a process mode N. Among them, setting of various functions such as touch curve setting and pedal assignment setting is performed in the function setting process mode. During the foregoing mode process management, the CPU 101 checks the state of the piano-only-switch flag through an interrupt and, if it is judged that the piano-only-switch flag is set, the CPU 101 checks based on flags whether the device is in the various-function setting state (function 1 setting flag, function 2 setting flag, . . . and function M setting flag). If any one of these flags is set, i.e. if any one of these functions is being set, the function setting process is stopped to compulsorily finish the function setting process mode. Then, the process is compulsorily shifted to the tone color selection mode wherein a command is given for setting the tone color to piano. In this structure, the initial image is automatically restored to allow a mode selection.

Figure 3:
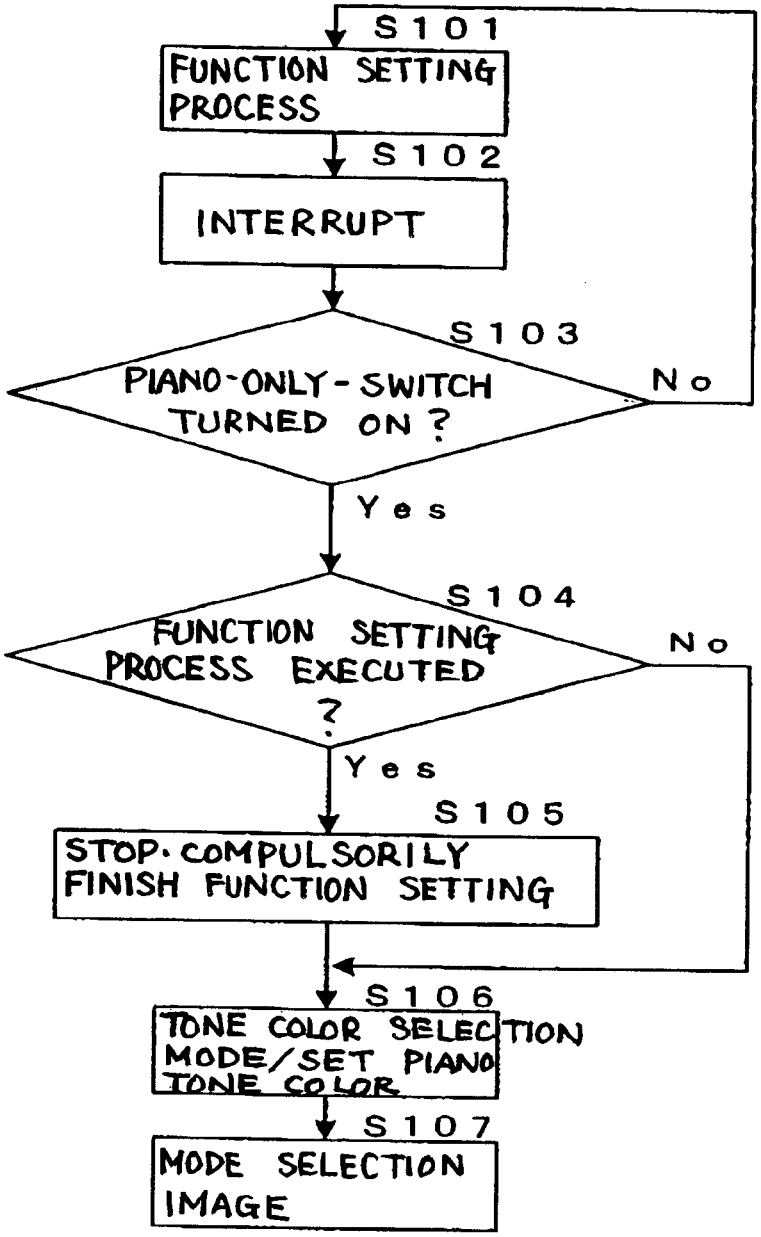
FIG. 3 is a flowchart showing a procedure of a tone color setting process when a piano-only-switch provided on a panel is depressed during a function setting process mode.

FIG. 3 is a flowchart showing a procedure of the tone color setting process when the piano-only-switch provided on the panel is depressed during the function setting process mode in the foregoing structure. Specifically, during the function setting process at step S101, the CPU 101 executes an interrupt (step S102) and judges based on the state of the piano-only-switch flag whether the piano-only-switch is depressed (step S103). If the piano-only-switch is not depressed (step S103; No), the processing returns to the foregoing step S101. On the other hand, if the piano-only-switch is depressed (step S103; Yes), the CPU 101 checks the flags of the various-function setting and judges whether the various-function setting is being executed (step S104). If the various-function setting is being executed (step S104; Yes), the function setting process is stopped to compulsorily finish the function setting process mode (step S105). Then, the process is compulsorily shifted to the tone color selection mode wherein a command is given for setting the tone color to piano (step S106). Thereafter, the initial mode selection image is restored (step S107).

Figure 4:
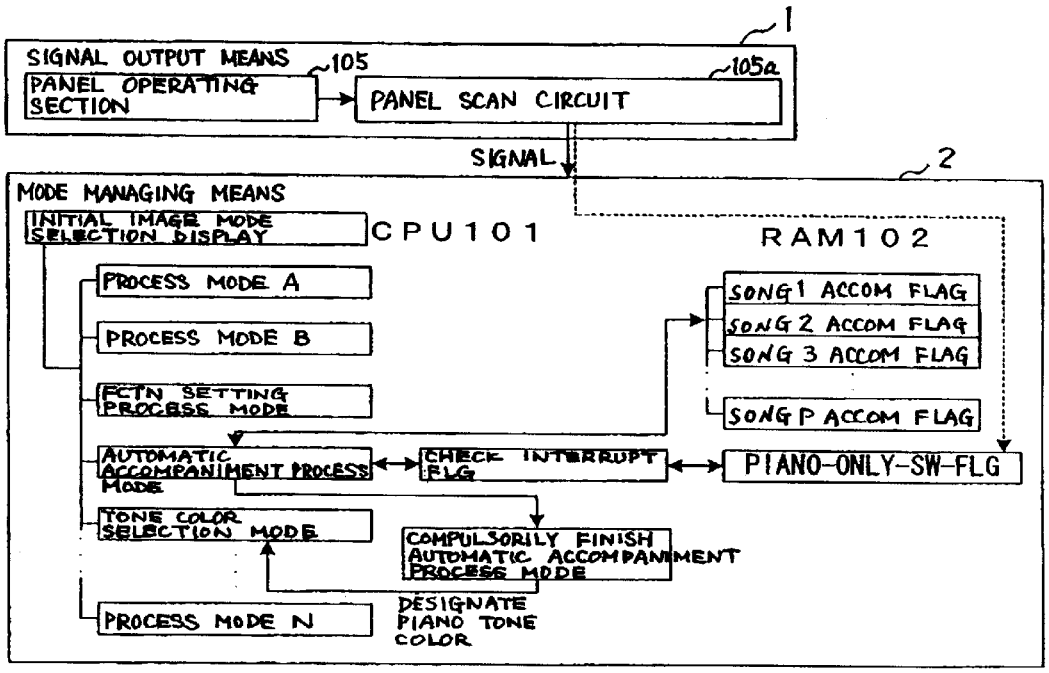
FIG. 4 is a functional block diagram of the present device when the piano-only-switch is depressed while a process mode is set to an automatic accompaniment process mode.

FIG. 4 shows functional blocks of the present device when the piano-only-switch is depressed while the process mode is set to the automatic accompaniment process mode in the foregoing structure. In the automatic accompaniment process mode, the CPU 101 checks the state of the piano-only-switch flag through an interrupt and, if it is judged that the piano-only-switch flag is set, the CPU 101 checks based on flags which of prestored songs is in the automatic accompaniment state (song 1 accompaniment flag, song 2 accompaniment flag, . . . and song P accompaniment flag). If any one of these flags is set, i.e. if any one of these songs is under the automatic accompaniment, the automatic accompaniment process is stopped to compulsorily finish the automatic accompaniment process mode. Then, the process is compulsorily shifted to the tone color selection mode wherein a command is given for setting the tone color to piano. In this structure, the initial image is automatically restored to allow a mode selection.

Figure 5:
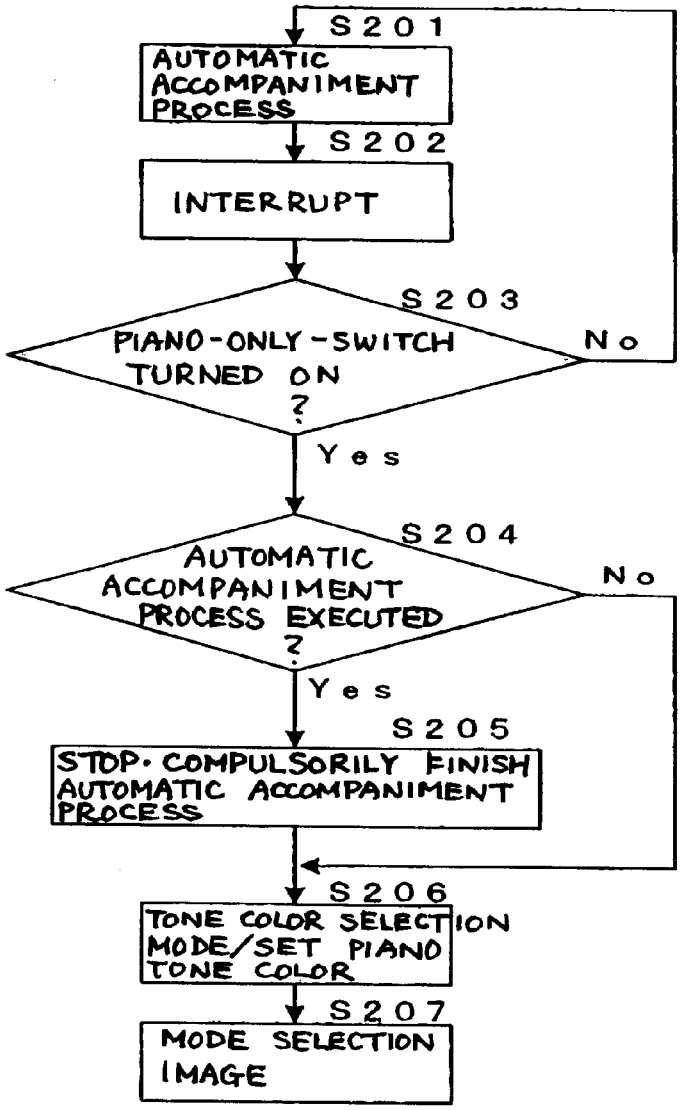
FIG. 5 is a flowchart showing a procedure of a tone color setting process when the piano-only-switch provided on the panel is depressed during an automatic accompaniment process mode.
Figure 6:
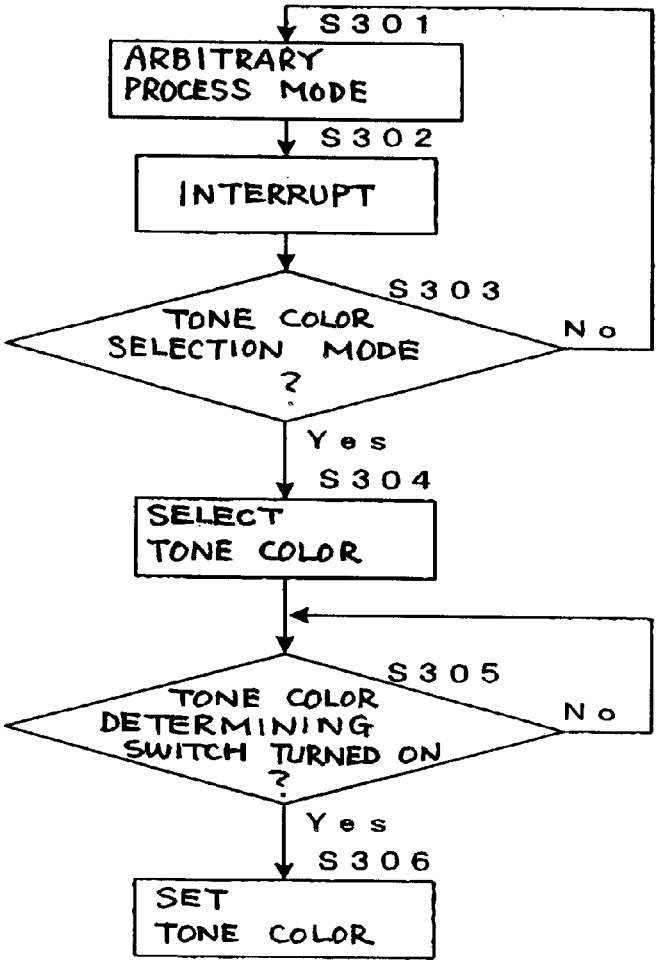
FIG. 6 is a flowchart showing a conventional tone color selection procedure which is executed through an interrupt during an arbitrary process mode.

FIG. 5 is a flowchart showing a procedure of the tone color setting process when the piano-only-switch provided on the panel is depressed during the automatic accompaniment process mode in the foregoing structure. Specifically, during the automatic accompaniment process at step S201, the CPU 101 executes an interrupt (step S202) and judges based on the state of the piano-only-switch flag whether the piano-only-switch is depressed (step S203). If the piano-only-switch is not depressed (step S203; No), the processing returns to the foregoing step S201. On the other hand, if the piano-only-switch is depressed (step S203; Yes), the CPU 101 checks the flags to see which of the songs is under the automatic accompaniment, and judges whether the automatic accompaniment process is being executed (step S204). If the automatic accompaniment process is being executed (step S204; Yes), the automatic accompaniment process is stopped to compulsorily finish the automatic accompaniment process mode (step S205). Then, the process is compulsorily shifted to the tone color selection mode wherein a command is given for setting the tone color to piano (step S206). Thereafter, the initial mode selection image is restored (step S207).

In the foregoing structure according to the present invention, when selecting the most frequently used tone color of piano in the type wherein the number of tone colors is large and thus it is not possible to provide tone color selection switches for all the tone colors on the panel, the piano tone color can be selected only by one operation of turning on the piano-only-switch on the panel as described above. Thus, with respect to the selection of the piano tone color, it is not necessary to perform the complicated procedure required for selecting the tone color which is used with a relatively low frequency, so that even a beginner can easily operate it.

Further, if function setting becomes unnecessary or a sound output is hastily required while setting functions under a plurality of hierarchies of the function setting process mode, it is not necessary to operate cancel switches or the like corresponding to those hierarchies for stopping the function setting, so that the piano tone color can be set only by depressing the piano-only-switch. The piano-only-switch makes it possible to compulsorily return to the simplest piano sound output state even when it is unknown how to achieve function setting while the function setting is executed.

Further, in case of stopping an automatic accompaniment function and setting only the piano tone color in an automatic accompaniment process mode of an electronic keyboard such as an electronic organ, the automatic accompaniment function can be stopped to set the piano tone color only by depressing the piano-only-switch. Moreover, even when selecting a tone color other than the piano during the automatic accompaniment, since all the functions are stopped by depressing the piano-only-switch, if a desired tone color switch is depressed thereafter, a tone color change can be achieved with a simple switch operation.

In the foregoing carrying-out mode structure, explanation has been made to the structure which can set a tone color to the piano tone color. However, the structure is not limited thereto, i.e. the tone color can also be compulsorily set to another tone color. For example, it is needless to say that it is possible to allow a user to select in advance a tone color which is to be compulsorily set using the only-switch. The tone color setting device of the present invention is not limited only to the foregoing embodiment, and various changes can be, of course, added thereto without departing from the gist of the present invention.

As described above, according to the structure of a tone color setting device of an electronic musical instrument recited in each of claims 1 to 3, when selecting the most frequently used tone color of piano in the type wherein the number of tone colors is large and thus it is not possible to provide tone color selection switches for all the tone colors on a panel, the target tone color can be selected through only one command operation by a user via a signal output means. Thus, if a frequently used tone color is set in advance, it is not necessary to perform a complicate procedure with respect to selection of that tone color. Therefore, there is provided an excellent effect that even a beginner can easily operate it.

Further, if function setting becomes unnecessary or a sound output is hastily required while setting functions under a plurality of hierarchies of the function setting process mode, it is not necessary to operate cancel switches or the like corresponding to those hierarchies for stopping the function setting. Thus, as described above, the target tone color can be set through only one command operation by a user via the signal output means.

Further, in case of stopping the automatic accompaniment function and setting only a particular tone color in the automatic accompaniment process mode of an electronic keyboard such as an electronic organ, the automatic accompaniment function can be stopped to set the tone color only through one command operation by a user via the signal output means.

INDUSTRIAL APPLICABILITY

The tone color setting device of the electronic musical instrument according to the present invention is advantageous in that a particular tone color can be immediately set through a one-touch operation in the electronic musical device in which a plurality of tone colors can be set. In particular, when an arbitrary process mode is executed, it is suitable for compulsorily finishing it and, at the same time, performing a compulsory tone color setting.

What is claimed is:

1. A tone color setting device of an electronic musical instrument, comprising:

signal output means for outputting a signal in response to a user command; and mode managing means, responsive to the signal outputted from said signal output means, for compulsorily finishing a currently executed process mode, and for compulsorily shifting to a tone color selection mode to set a predetermined tone color, said currently executed process mode being other than said tone color selection mode.

2. The tone color setting device according to claim 1, wherein said currently executed process mode is a function setting process mode for setting at least one of predetermined functions provided in the electronic musical instrument.

3. The tone color setting device according to claim 1, wherein said currently executed process mode is an automatic accompaniment process mode for a song selected from a plurality of songs provided in the electronic musical instrument.

4. The tone color setting device according to claim 1, wherein said predetermined tone color is a tone color of piano.

5. A tone color setting device of an electronic musical instrument having at least a first and a second process mode, said first process mode being a tone color selection mode for setting a predetermined tone color and said second process mode being other than said tone color selection mode, said tone color setting device comprising:

signal output means for outputting a signal in response to a user command; and mode managing means, responsive to the signal outputted from said signal output means, for compulsorily finishing said second process mode when being executed, and for compulsorily shifting to said first process mode to set said predetermined tone color.

6. The tone color setting device according to claim 5, wherein said second process mode is a function setting process mode for setting at least one of predetermined functions provided in the electronic musical instrument.

7. The tone color setting device according to claim 5, wherein said second process mode is an automatic accompaniment process mode for a song selected from a plurality of songs provided in the electronic musical instrument.

8. The tone color setting device according to claim 5, wherein said predetermined tone color is a tone color of piano.

* * * * *